US005934466A

United States Patent [19]

Loeffler

[11] Patent Number: 5,934,466

[45] Date of Patent: Aug. 10, 1999

[54] STACKABLE INTERLOCKING TOOLBOX

[76] Inventor: Cleo J. Loeffler, 9862 W. Kentucky Dr., Lakewood, Colo. 80226

[21] Appl. No.: 09/005,211

[22] Filed: Jan. 9, 1998

[51] Int. Cl.[6] ..... B65D 85/00

[52] U.S. Cl. ..... 206/372; 206/503; 220/4.27

[58] Field of Search ..... 206/503, 506, 206/508, 509, 511, 372, 373; 220/4.27

[56] References Cited

U.S. PATENT DOCUMENTS

| | | | |
|---|---|---|---|
| 2,807,387 | 9/1957 | Siciliano | 206/509 X |
| 3,182,856 | 5/1965 | Goltz | 220/4.27 |
| 4,724,756 | 2/1988 | Sarparanta | 220/4.27 X |
| 5,083,664 | 1/1992 | Feng | 206/509 X |
| 5,375,709 | 12/1994 | Petro | 206/509 |
| 5,445,269 | 8/1995 | Williams | 206/503 X |

*Primary Examiner*—Jacob K. Ackun
*Attorney, Agent, or Firm*—Thomas W. Hanson

[57] ABSTRACT

A toolbox, designed to be used as part of a set of similar toolboxes, which has a tongue and groove along the top edge of both sides and a mirror image tongue and groove along the bottom edge of both sides. Two toolboxes made according to the invention can be coupled together by slidably joining the upper tongue and groove of one with the lower tongue and groove of the second. The two toolboxes are thereby stacked and can be handled as a single unit. Additional toolboxes can be added to the stack in any order the user desires. A cover is also provided which mates with the upper tongue and groove and also provides a centrally mounted top handle. A rack mount is provided which mates with the lower tongue and groove to provide a stationary mounting for one or more toolboxes either in a workshop or a vehicle.

17 Claims, 9 Drawing Sheets

STACKABLE INTERLOCKING TOOLBOX

FIELD OF THE INVENTION

The present invention relates to toolboxes, and specifically to portable toolboxes which stack and interlock.

BACKGROUND OF THE INVENTION

Toolboxes of many styles are well known. They are commonly made from a variety of materials and in a variety of shapes. Most are portable, but others, often referred to as tool chests, are stationary or wheeled and intended for use within a work shop. In almost all cases, the tool boxes are compartmented to separate different types of tools from each other. Portable toolboxes are limited in capacity so that they can be carried when filled with tools.

The weight and capacity limit of portable toolboxes often results in a person with a large number of tools using several tool boxes. This combines with the desire to compartmentalize the different types of tools. The typical end result is a different toolbox for each specific type of tool. This is especially true of trades people and craftsmen who use their tools on the job. Depending on the job, or the work to be performed, a different selection of toolboxes will be taken to the job site with the remainder left in the shop.

Each trade or craft, and each person will have a different scheme for categorizing tools and dividing them between toolboxes. A carpenter may distinguish between framing and finish tools with subcategories for saws, planes, measuring tools, screwdrivers, etc. A mechanic may have wrenches (with English and metric versions), pliers, ignition tools, measuring tools all stored separately. Plumbers and electricians may also use toolboxes to store fittings, connectors, and other consumable supplies.

The common goal of all of the types of users is to have their tools and supplies organized, easily accessible, portable, and to be able to take only a subset with them as needed for a particular job. At present, this is done by taking several different toolboxes along. Unfortunately, this usually means several trips between the shop and vehicle, and then the vehicle and job site, carrying one or two boxes per trip. Another disadvantage to this approach is the need to keep track of, and secure, several separate toolboxes.

There is a need for a portable, stackable toolbox where several can be combined into a single unit for transportation. The toolboxes should be available in a variety of sizes. It should be possible to combine the boxes in any order and in any combination. The stacked toolboxes should interlock so that the combination can be handled as a single item. It should be possible to easily separate the individual toolboxes for access and so that they can be positioned and stored separately. Ideally, the toolboxes, individually or as a stack, could be physically secured to a mounting device either in a vehicle or in the shop. Even more desirable would be if the mounting system in the shop would allow the toolboxes to be used as drawers, sliding in and out for access to each box individually.

SUMMARY OF THE INVENTION

The disclosed invention is a new design for a toolbox which utilizes an interlocking configuration of the top and bottom of the sidewalls which allow them to mate together. A latching mechanism locks the adjacent boxes in their mating position and can be released to separate the boxes. In the preferred embodiment, this mating is achieved by a tongue and groove formed into the top edge of the sides. A mirror image tongue and groove is formed in the bottom edge. Two boxes can be slid together, with their tongues and grooves matching to form a stacked unit which can be treated as one. By using the same configuration on all boxes, they can be stacked in any combination and in any order.

In a further embodiment, the tongue and groove arrangement is provided on one or both ends to strengthen the connection between the two boxes. Where the interlock is provided on both ends, one end will be raised above the sides and the other end to allow the ends to mate as they are slid together. Alternatively, one end could be lowered below the side to achieve the same result.

In a still further embodiment, a cover is provided which has only the bottom set of grooves. This cover is fitted to the top of the stack, sealing the topmost toolbox and providing a top handle which allows the stack to be carried with one hand.

In yet a further embodiment, a system of storage boxes is provided which includes one or more boxes, a cover, and a rack mount for storing the boxes in a workshop or vehicle. The rack mount allows the boxes to individually slide out, similar to a drawer, for access to their contents. A latch prevents the boxes from sliding fully out until it is released.

The above and other features and advantages of the present invention will become more clear from the detailed description of a specific illustrative embodiment thereof, presented below in conjunction with the accompanying drawings.

DESCRIPTION OF THE PREFERRED EMBODIMENT

The following discussion focuses on the preferred embodiment of the invention, which utilizes a mating tongue and groove configuration to provide a sliding joint between two adjacent boxes. However, as will be recognized by those skilled in the art, the disclosed apparatus can be manufactured using various similar configurations to achieve the same result.

The following is a brief glossary of terms used herein. The supplied definitions are applicable throughout this specification and the claims unless the term is clearly used in another manner.

Front, Back—front is the direction towards which the box slides to release, back the opposite direction, towards which the box slides to seat or latch Depth—vertical distance from top to bottom of box.

Tongue and groove—a joining technique common in the woodworking arts which can take several similar forms. In its most general form the tongue is adjacent to the groove and they share a common surface which defines the boundary between them. The tongue protrudes outward relative to the groove and the groove is inset relative to the tongue. The tongue may protrude above the piece in which the tongue and groove is formed. In this case the groove may be either inset into the piece or be flush with the normal surface of the piece, defined solely by the tongue and possibly by an adjacent tongue. Alternatively, the tongue may be flush with the surface of the piece with the groove formed as an inset into the piece. It is also possible to form both tongue and groove as inset below the surface of the piece. A tongue and groove joint is generally formed by a pair of mirror image tongues and grooves in the two pieces to be joined with the tongue on one piece sized to fit into the matching groove on the other piece. A simple joint will use a single tongue on the first piece and a single groove on the second piece.

Upper, Lower—relative position within the stack of boxes with upper being towards the top.

The disclosed invention is described below with reference to the accompanying figures in which like reference numbers designate like parts.

Figure 1:
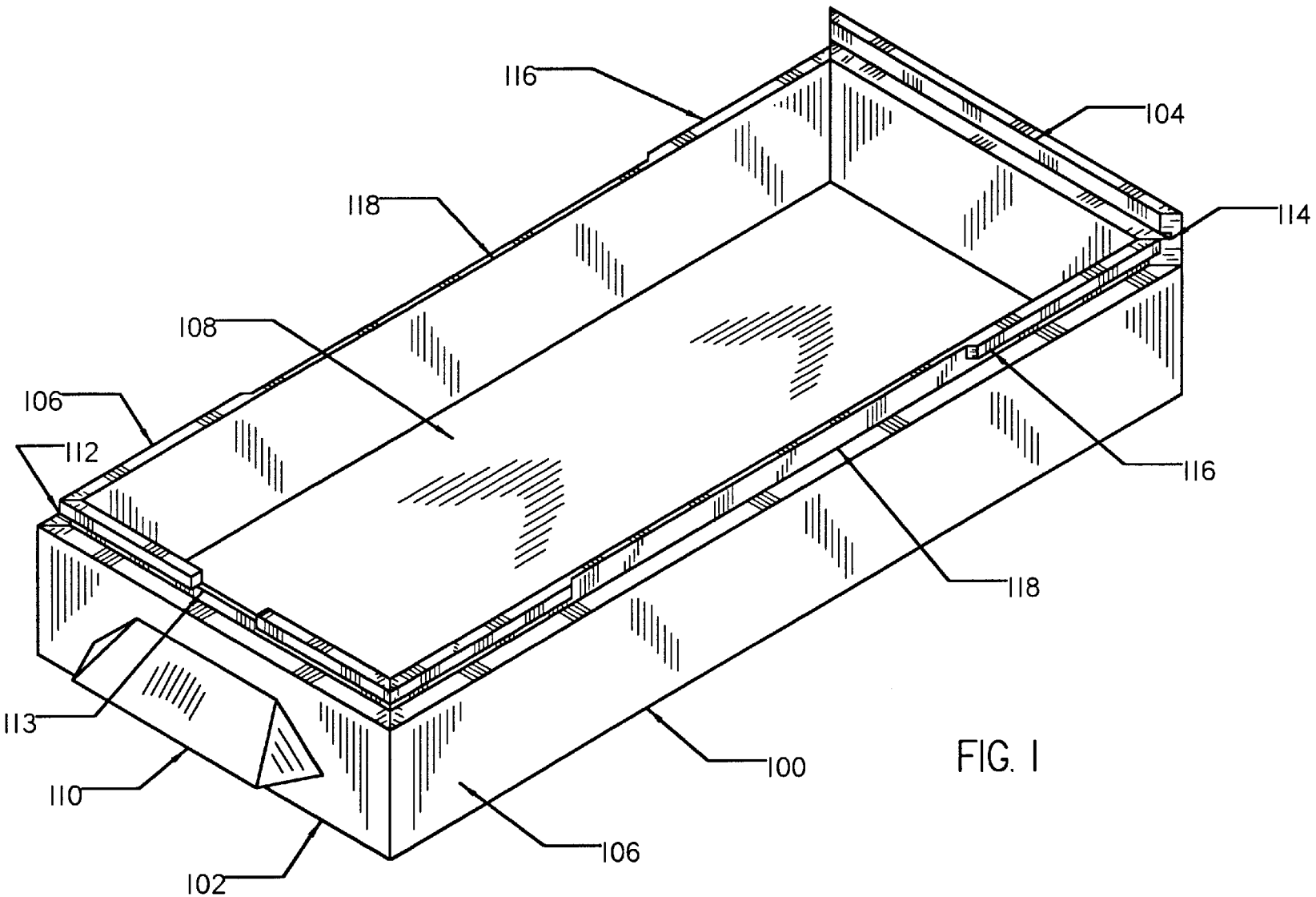
FIG. 1 is a perspective view of a box according to the present invention.

Referring to FIG. 1, it can be seen that the basic structure of the disclosed invention, 100, is that of a simple box with two ends, 102 and 104, two sides, 106, and a bottom, 108. The boxes can be of any depth. A handle, 110, is provided on each end for convenience. The unique features of the invention are those which have been added to allow stacking of the boxes.

A tongue and groove, 112, is formed along the top of both sides, 106, and one end, 102. The opposite end, 104, is raised above the level of the sides and is formed with a groove, 114, which mates with a tongue, 122 in FIG. 2, in the end of upper box, as discussed below. In the preferred embodiment the tongue along the sides, 116, does not continue through the center portion, 118. This allows the upper box, or the cover, to be lifted off after being slid only partially toward the end. Alternatively, the tongue could be made continuous for the full length of the box. The mating mechanism will be discussed in more detail below gap, 113, in the front edge provides clearance for the latch as use in the preferred embodiment. Other approaches to latching may not need this gap.

Figure 2:
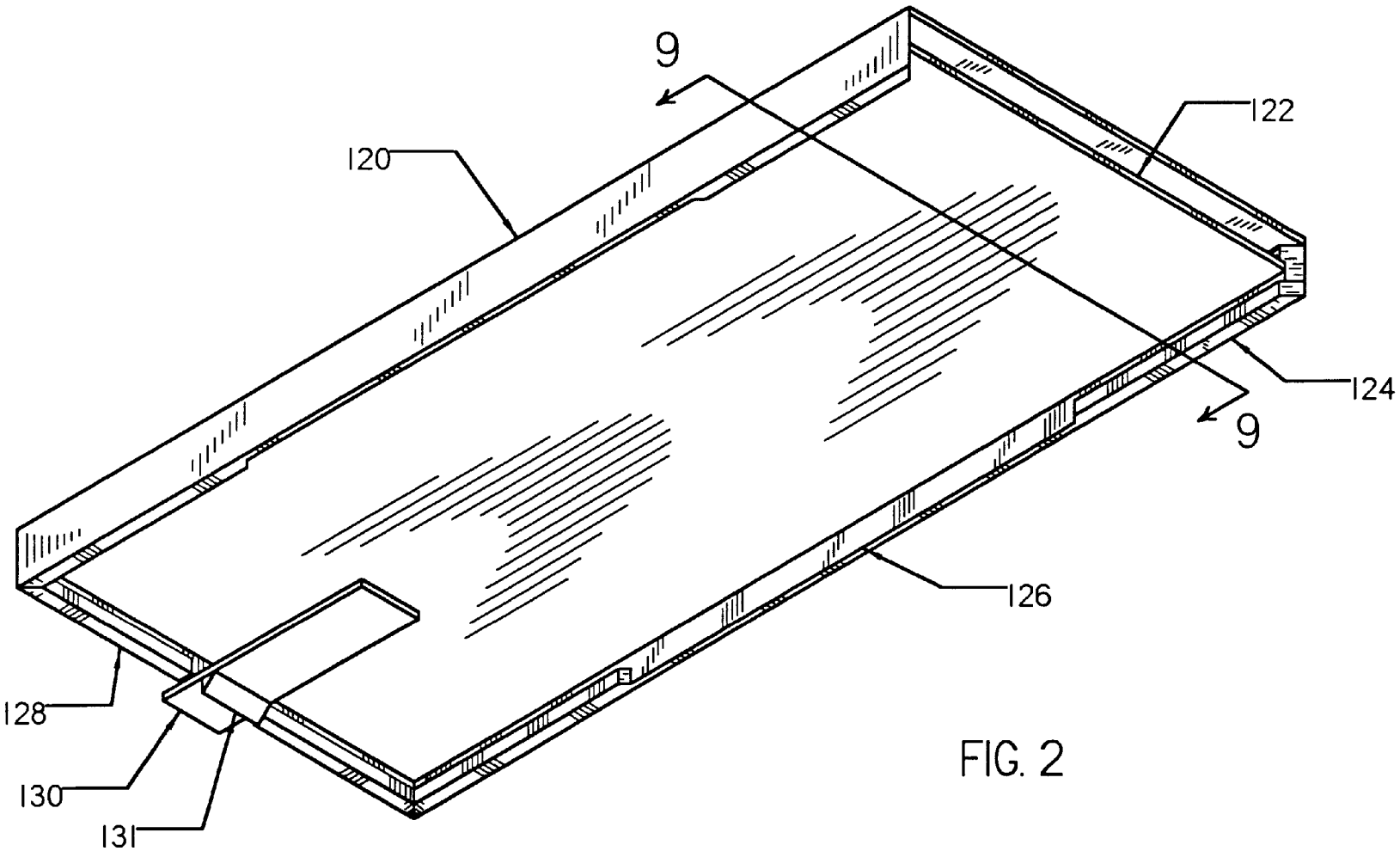
FIG. 2 is a perspective view, from below, of a lid according to the present invention.

FIG. 2 illustrates the configuration of the optional cover which slides onto the uppermost box in a stack. The tongue and groove configuration of the lid is identical to that used on the bottom of the boxes. The tongue and groove, 124, along the sides and one end, 128, is a mirror image of that on the top edges of the box allowing them to interlock. A gap, 126, in the tongue, corresponding to that in the top edge of the box, allows the cover, or upper box, to be lifted off. In the preferred embodiment, the cover is constructed with a double wall top surface. The protruding end, 122, of the inner wall serves as the tongue which mates with groove, 114, in the end of a box. Alternatively, this function could be performed by a separate tongue. Latch, 131, engages the front edge of the box when the cover is in place. It is released by moving lever, 130, upward. In the preferred embodiment, the lever is formed from a flexible material to also serve as a biasing means.

Figure 3:
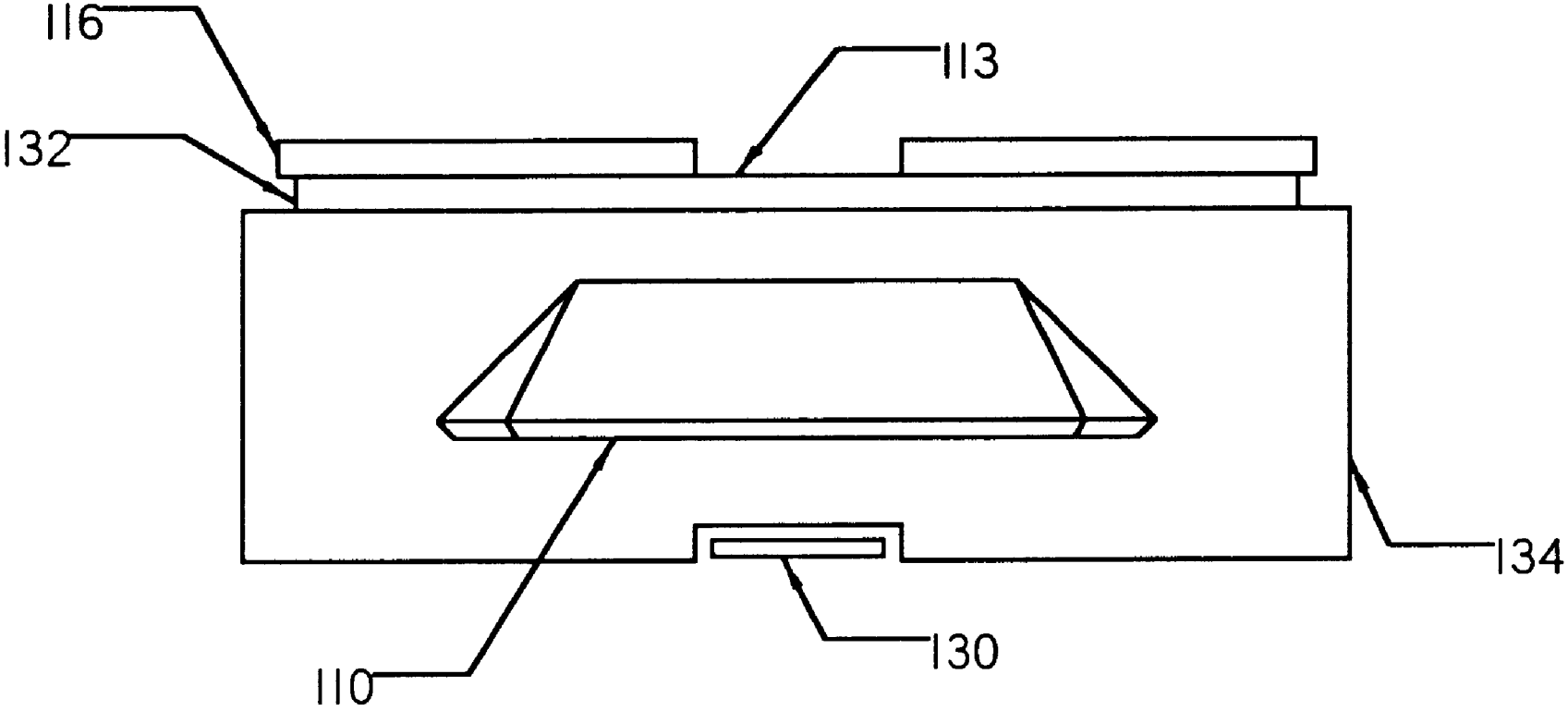
FIG. 3 is a front view of a box according to the present invention.
Figure 4:
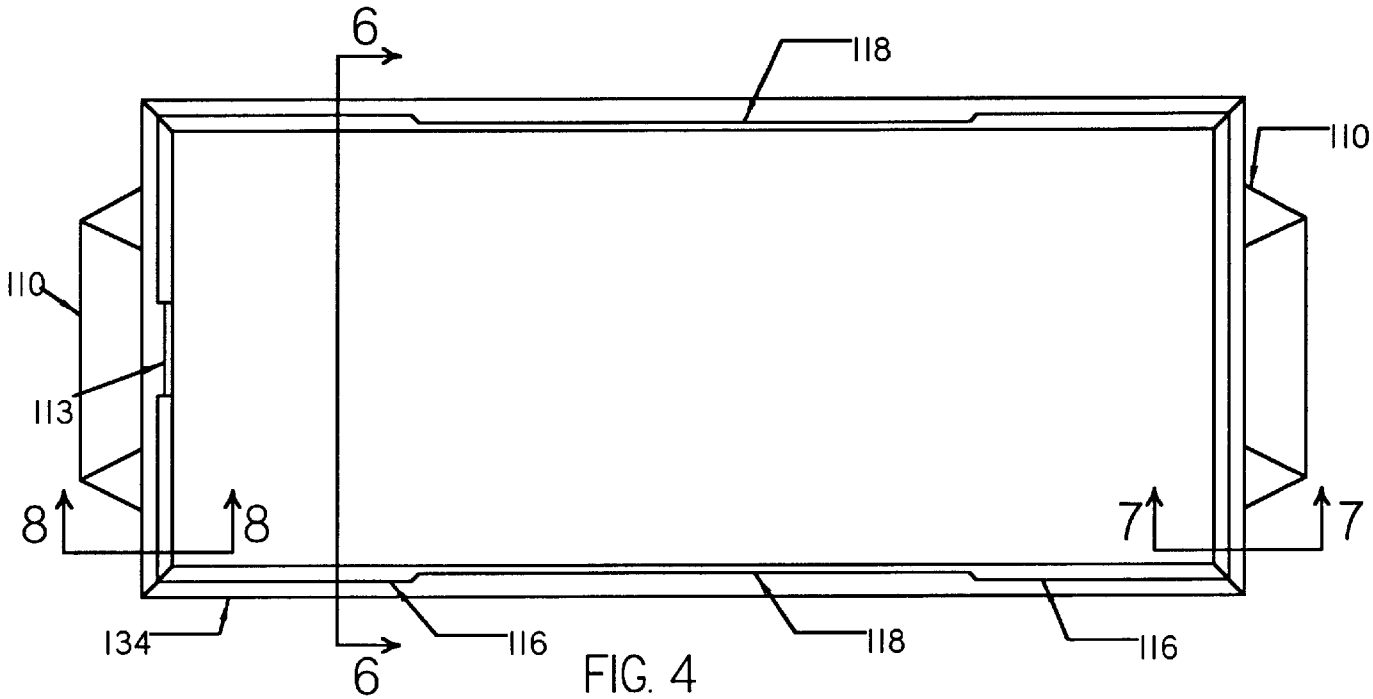
FIG. 4 is a top view of the box.
Figure 5:
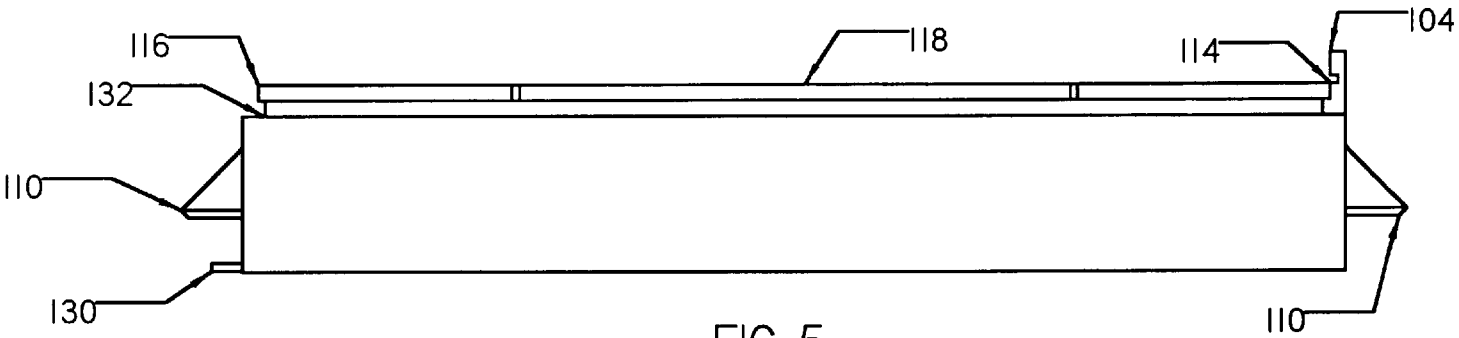
FIG. 5 is a side view of the box.

FIGS. 3–5 provide a more detailed view of the structure of the box. Shown in profile in FIG. 3 and FIG. 5, the design of the tongue and groove achieves several purposes. Clearly, its main function is to interlock two boxes. This is achieved by the typical structure of the tongue and groove. The groove, 132, is inset below the tongue, 116, and receives the corresponding tongue in the bottom of the upper box. When the upper box is then lifted, as when carrying the stack by the top handle on the cover, the upper surface of the tongue on the upper box bears on the lower surface of the tongue, 116, of the lower box.

Figure 13:
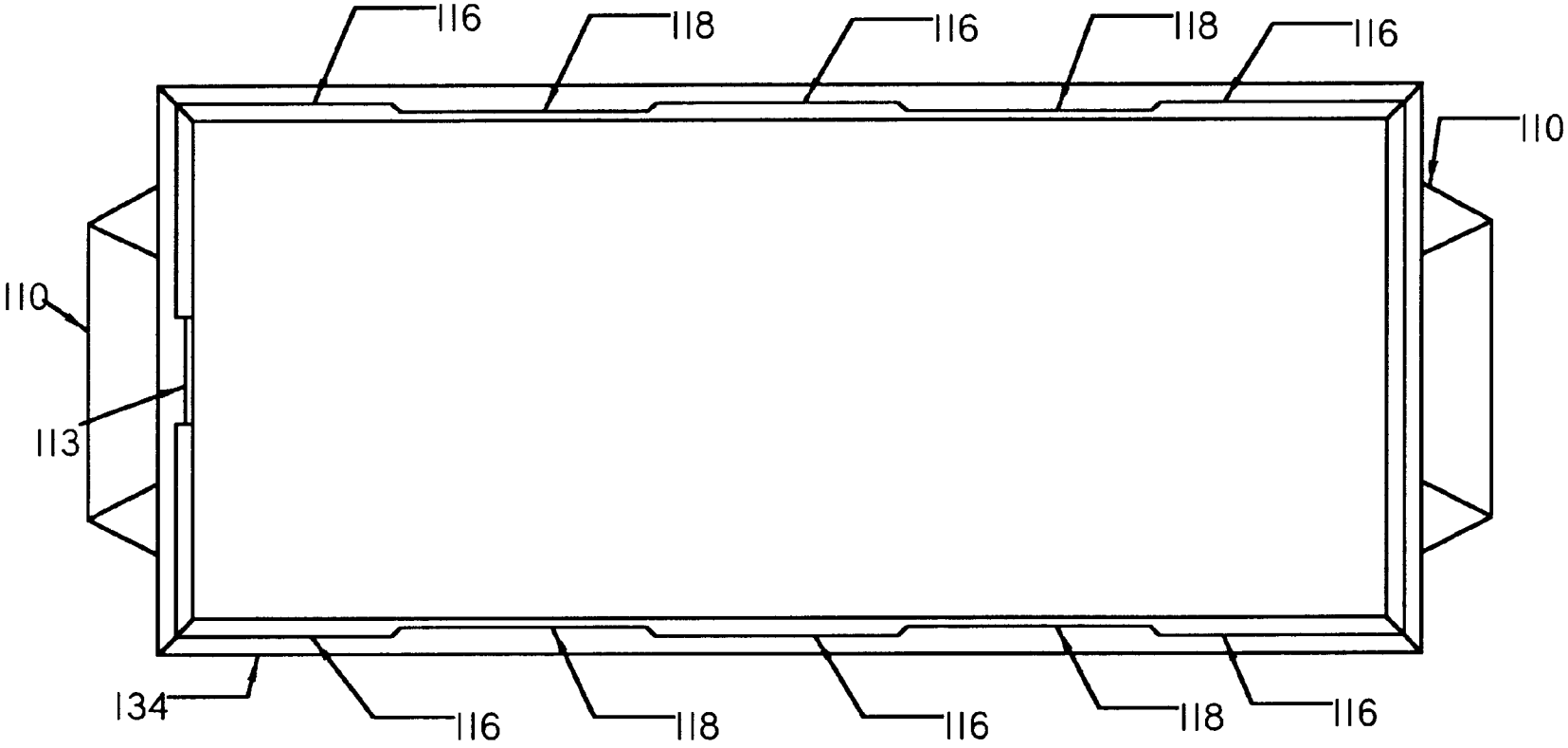
FIG. 13 illustrates an alternative embodiment in which plural gaps are formed in the tongue and groove joint.

The mating function of the tongue and groove would be well served by a continuous tongue and groove along the full length of the sides. However, this would require that the boxes slide lengthwise relative to each other for the full length of the boxes to unmate them. By forming the relief, 118 in FIGS. 4 and 5, in the tongues, the boxes will unmate after sliding only the length of the tongue left at each end. In the preferred embodiment, this is approximately 25% of the length of the box. Alternatively, multiple reliefs, or gaps, could be formed in the tongue, as shown in FIG. 13, resulting in shorter sections of intervening tongue and thus shorter sliding distances required to unmate the boxes. The number of gaps is limited only by the length of the intervening tongue and the amount required to form an effective joint. This will vary with the material selected. Two or three gaps should be effective in almost any material.

In the preferred embodiment, a second purpose is achieved by insetting the tongue, 116, slightly from the outer edge of the box, 134. This allows the sides of the boxes to be formed as a continuous flat surface with no bulge or protrusion at the point of the joint. A third purpose is achieved by the relative arrangement of the tongues and grooves on the top and bottom of the boxes. By placing the bottom set to the outside of the top set, the bottom edge of the upper box forms an overlapping skirt around the top edge of the lower box. This results in a highly weather resistant connection on three edges of the box.

The latch lever, 130, operates the latch which serves to prevent unintentional sliding movement between two mating boxes by locking them in a fixed relative longitudinal position. This effectively locks the two boxes together as the tongue and groove joint can be unmated only by sliding it apart. In the preferred embodiment a simple catch is used which is spring biased to engage the lip the of the lower box. Any of several well known means of preventing sliding motion, such as pins, pawls, or detents could also be used.

Figure 6:
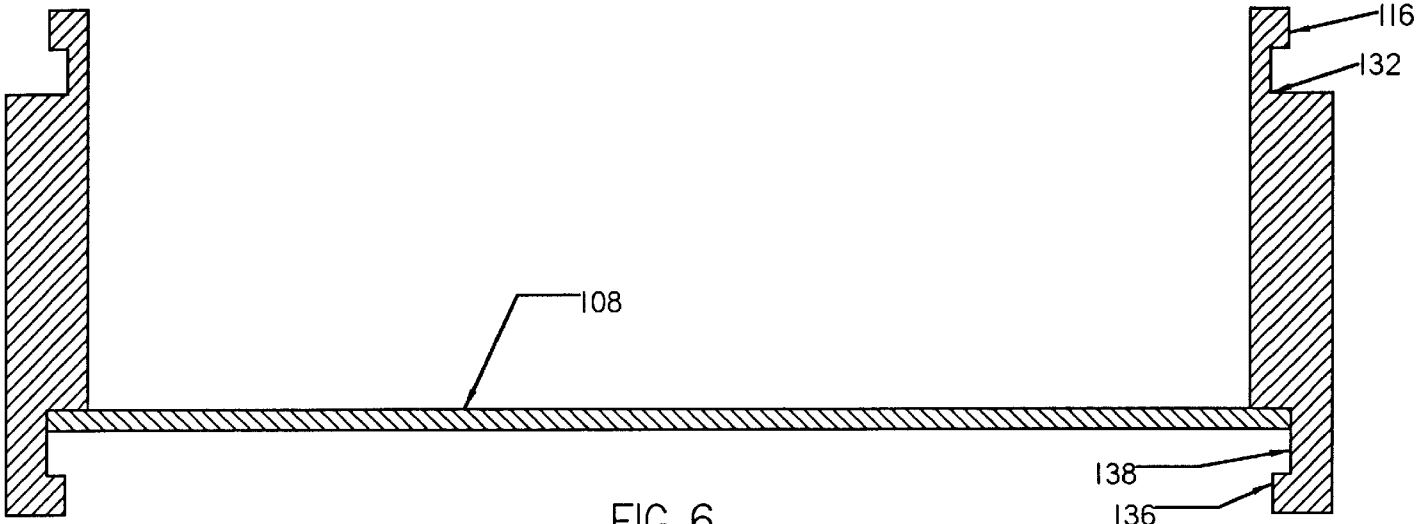
FIG. 6 is a cross section through the box according to a first embodiment.

The profile of the sides and the tongue and groove portions, as used in a first embodiment of the invention, is shown in FIG. 6. The upper and lower edges are essentially mirror images of each other. Tongue, 116, in the upper edge is sized to be received in groove, 138, in the lower edge of an upper box. Similarly, tongue, 136, in the lower edge is sized to be received in groove, 132, in an upper edge. The bottom of the box, 108, may be a separate piece, as shown, or may be formed integrally with the sides. The factors driving this decision are primarily the manufacturing characteristics of the selected material for the box.

Figure 6C:
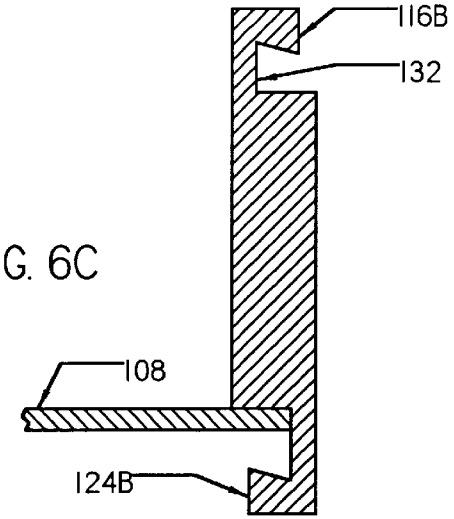
FIG. 6C is a cross section through one side of the box showing a third embodiment of of the side.
Figure 6B:
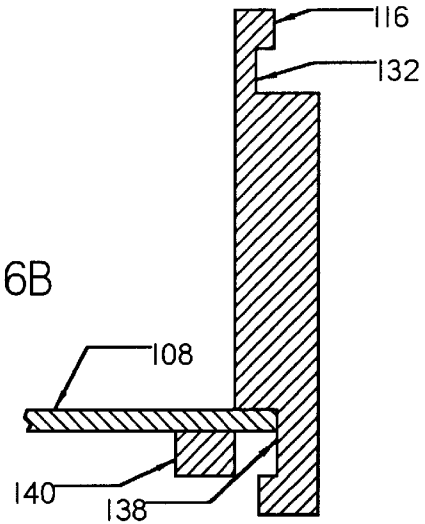
FIG. 6B is a cross section through one side of the box showing a second embodiment

A second embodiment of the sides is shown in FIG. 6B. A retaining rib, 140, is added to assist in retaining tongue, 116, within the slot, 138. Depending on the length of the box, the material from which it is made, and the weight supported by the box, the side walls may bow inward under stress allowing the tongue and groove joint to separate. The rib prevents this separation if the walls bow. A third embodiment of the sides is shown in FIG. 6C. Addressing the same problem as the second form, here the profile of the tongues, 116B and 124B, are altered to provide a slope to the mating surface. When a lifting force is applied to the upper box, the slope urges the tongues deeper into the grooves, offsetting the tendency to of the joint to separate. Where an even stronger joint is desired, the techniques of both the second and third embodiments can be combined.

Figure 7:
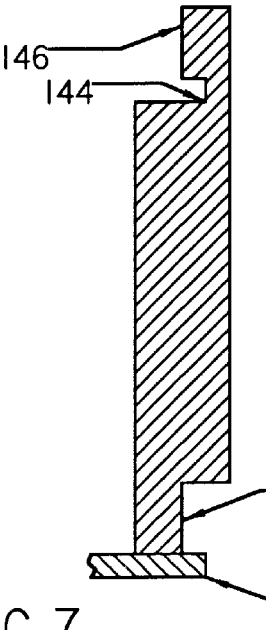
FIG. 7 is a cross section through the end of the box according to a first embodiment.

The profile of a first embodiment of the rear wall is shown in FIG. 7. The bottom of the box, 142, protrudes beyond a groove, 148, formed in the bottom edge. These combine to form a tongue and groove which will mate with the corresponding tongue, 146, and groove, 144, in the top of the adjoining box. Functionally, this corresponds to the protruding segment of the inner wall, 122, of the top surface of the cover as illustrated in FIG. 2. The tongue, 146, protrudes above the side walls so that it can mate with the box bottom which rests on the top of the side walls.

Figure 7B:
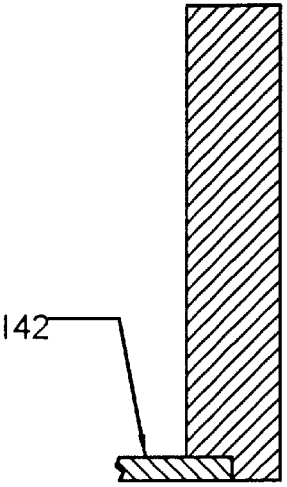
FIG. 7B is a cross section through the end of the box showing a second embodiment.
Figure 8:
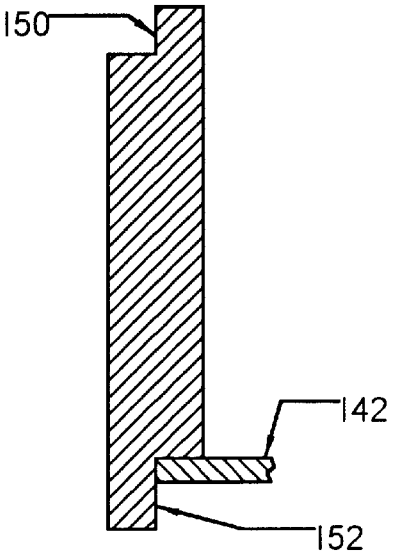
FIG. 8 is a cross section through the front of the box according to a second embodiment.

The use of the tongue and groove joints in the front and rear end walls is optional. While it does strengthen the connections between two adjacent boxes, it adds to the complexity and cost of the manufacturing process and decreases the aesthetic appearance of the box. It also increases the required spacing used in the rack mount discussed below. Where the box material and anticipated load permit, the mating joints in the ends can be eliminated. FIG. 7B shows a second embodiment of the rear end with the tongue and groove eliminated along with the elevated portion of the wall. A similar approach may be taken with the front wall or a simple lap joint can be used as shown in FIG. 8. Rabbets, 150 and 152, are formed in the top and bottom edges and mate when two boxes are slid together. The advantage to this approach is that the overlap serves as a stop when the boxes are joined. Unlike the rear end, this overlaps causes no increase in the height of the box.

Figure 9:
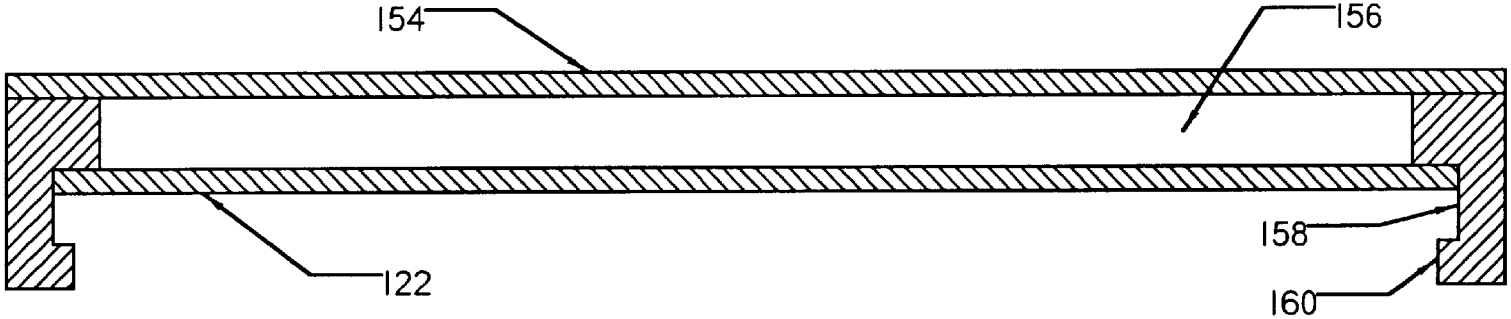
FIG. 9 is a cross section through the lid.

FIG. 9 illustrates the structure of the cover shown in perspective in FIG. 2. Tongue, 160, corresponds functionally to the tongue, 136, in the bottom edge of the sides and groove, 158, corresponds functionally to groove, 138. This correspondence allows the cover to be mated to any of the boxes. Gap, 156, is sized to receive the tongue, 146, in the top of the rear wall in the first embodiment. The outer wall, 154, of the top surface fully overlaps the rear end while the inner wall, 122, is received into the groove, 144. If the rear wall is formed according to the second embodiment, this gap can be eliminated and, if desired, the cover can use only a single wall for the top surface. In the preferred embodiment, a centrally located handle will be attached to the top surface of the cover. This allows a stack of toolboxes to be carried with one hand.

Figure 10:
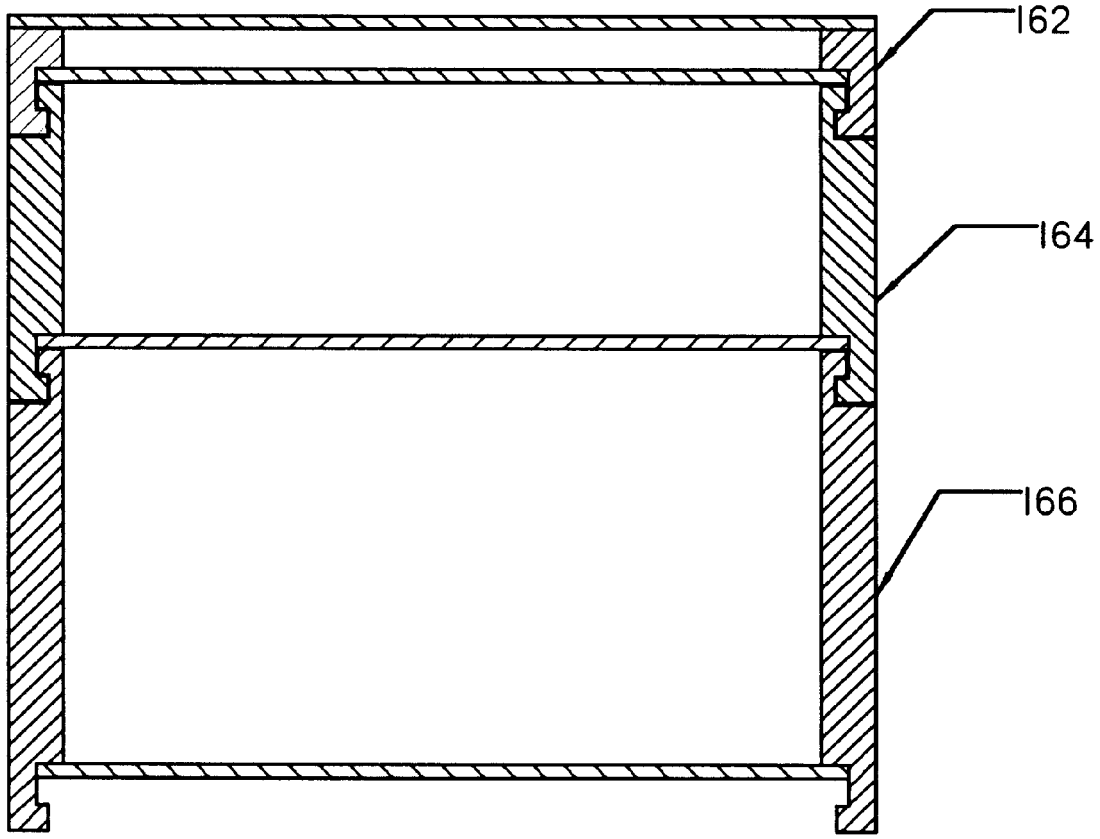
FIG. 10 is a cross section through a set of boxes and lid as they are stacked.

A typical stack of toolboxes is illustrated in cross section in FIG. 10. Two boxes, 164 and 166, have been coupled together and topped with cover 162. These three pieces can now be handled as a single unit, simplifying their transportation. The order of the two boxes can be altered or additional boxes can be added to the stack. As shown, the boxes can be of varying height. If desired, the cover can be left off, or the cover and a single box can be used.

Several alternative implementations exist for parts of the disclosed invention which are functionally equivalent to those used in the above embodiments. Generally, swapping the locations and orientations of the tongues and grooves results in a joint of similar functionality. A specific application of this is the groove which is formed in the raised rear end of the box. This could be replaced with a tongue which is received into a groove in the end of the upper box, or cover. This could be advantageous where sheet metal is used to form the box as the tongue could be formed as a bent lip at the edge of the sheet. This joint could also be formed as a pair of overlapping lips rather than a groove as the joint only needs to resist movement in the upward direction. Where a single pair of a tongue and a groove are used, plural parallel sets could be substituted for a stronger joint. The orientation of the joints relative to the box could also be altered. Placing the sliding tongue and groove joints along the short side of the box would provide quicker opening of the box at the expense of a weaker connection between the boxes. Where both the front and rear joints are also used, the overall interconnection would probably be satisfactory.

The disclosed invention can be manufactured from several different materials, or combinations of materials, with satisfactory results. The material should be matched to the size of the production run, the desired production cost, the weight to be supported, and the target market or end user. For mass production with moderate weights injection molded plastic would work well. The addition of the retaining rib and/or the sloped faces for the tongue and groove joint would sufficiently strengthen the joint to allow the use of injection molding for heavier loads. Wood also performs well for medium weights and small production runs as does medium density fiberboard (MDF). This would be a good choice when the product is targeted to carpenters and woodworkers. The look and feel of the wood is more attractive to those who work with it and the weight capacity is well matched to the type of tools that are likely to be carried. Stamped sheet metal is a good choice for high volume production where greater weight capacity is needed. This has the added advantage of being more resistant to abuse of the box itself. This type of construction would be suitable to mechanics and possibly machinists whose tools are heavier. An alternative construction, also suited to machinists would be to form the box from machined metal parts. As with wood for carpenters, the material and construction method would appeal to the end user. This approach would also provide a high degree of protection for delicate instruments such as micrometers and calipers. The various approaches could also be combined as needed. For example, a machined or stamped steel tongue and groove strip could be attached to a wood or plastic body for a medium priced, stronger box.

Figure 11:
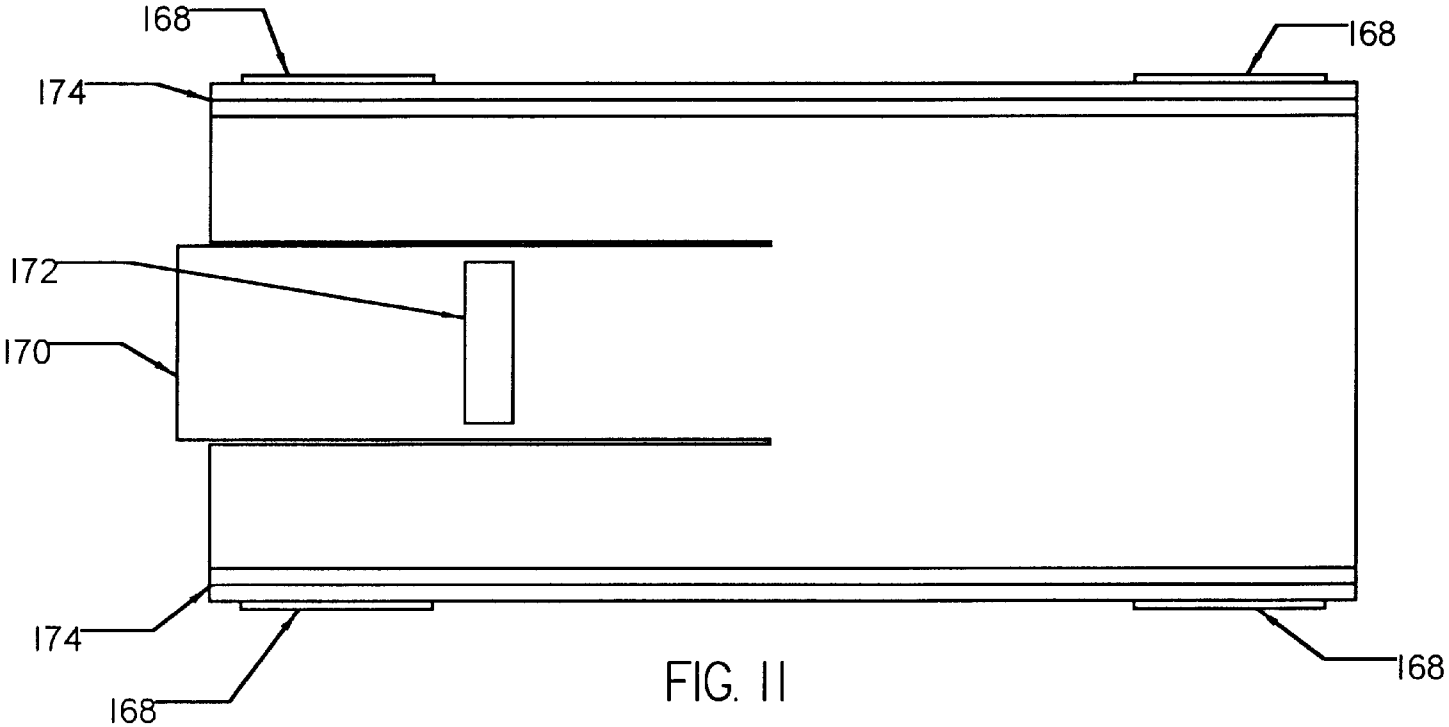
FIG. 11 is a top view of a rack mount for the box.
Figure 12:
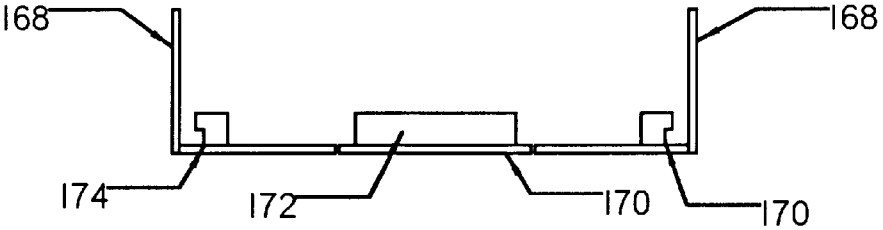
FIG. 12 is a front view of the rack mount for the box.

A toolbox made according to the disclosed invention could be supplemented by a rack mounting system. The rack mount, shown in FIGS. 11 and 12, would be fixed to a set of vertical posts using mounting tabs, 168. The rails, 174, are correspond to the tongue and groove formed on the top edge of a box. This allows a box to be slid into the rack mount with its bottom tongue and groove mating with the rails where it will be held in place. A box which has been inserted in the rack mount can then slide in and out similar to a drawer. A series of rack mounts can thus function similarly to a tool chest in a work shop. But, as opposed to the tool chest, the rack mount allows the individual boxes to be removed, stacked, and taken to the job site as a portable toolbox. The latch, 172, which engages the bottom edge of the rear wall, prevents the box from sliding completely out of the rack unless the release lever, 170, is depressed to release the latch. In the preferred embodiment this latch is separate from the latch which hold the boxes coupled together. A single combined latch could be used for both if desired. Many equivalent latching mechanisms can be used to achieve the same result. A similar rack mount can be used in a vehicle to hold single or stacked boxes in place as the vehicle moves. Altering the mounting tabs to an L shape, or similar, allows the mount to be attached to a horizontal surface such as a truck bed. A lock which fixes the latch in a closed position, or physically couples the boxes to the rack mount would provide security for the toolboxes when they are unattended in a vehicle.

The way in which a set of toolboxes according to the present invention would be used can be illustrated by a simple scenario. As a tradesperson prepares to leave their workshop for a job site, they identify the set of tools needed for the specific task to be performed. The individual toolboxes containing those tools are located and removed from their rack mounts by releasing the latch, allowing them to be fully extracted. The boxes are then assembled into one or more stacks of boxes according to the users preference. This may place the tools in order of use, or with the heaviest on the bottom, or possibly with the largest boxes on the bottom. The ordering is entirely at the choice of the user. Each stack of boxes is then topped with a cover and the toolbox stacks taken to the vehicle. There, they are slipped into a second set of rack mounts which are permanently attached to the vehicle and positioned to hold complete stacks of boxes. After the tradesperson reaches the job site, the toolbox stacks are removed from the vehicle and taken to the work location. Then, they may be left stacked, or unstacked and arranged for easy access to the tools. At the end of the day, or job, the toolboxes are restacked, mounted on the vehicle for return to the shop, and reinserted in their rack mounts available for use in the shop or again selected for use at the next job site.

While the preferred form of the invention has been disclosed above, alternative methods of practicing the invention are readily apparent to the skilled practitioner. The above description of the preferred embodiment is intended to be illustrative only and not to limit the scope of the invention.

I claim:

1. A stackable toolbox comprising:

(a) a box comprising 2 parallel opposing sides, 2 parallel opposing ends connected to said sides, and a bottom connected to said sides and said ends and (b) means for mating two boxes, comprising:

(i) a first part attached to the top edge of each of said sides, having a first lateral projection, and (ii) a second part attached to the bottom edge of each of said sides having a second lateral projection facing oppositely to said first lateral projection, (iii) said first part and said second part adapted to couple together by sliding together along their longitudinal axis, with said first and second lateral projections overlapping (iv) each of said first and second lateral projections comprising two spaced apart sections defining an intervening gap at least as long as the shortest of said sections.

2. The stackable toolbox of claim 1 further comprising latching means for preventing relative movement between two stacked toolboxes.

3. The stackable toolbox of claim 1 wherein said first part comprises a first tongue and groove and said second part comprises an oppositely facing second tongue and groove.

4. The stackable toolbox of claim 1 wherein said gap is in the range of 40% to 60% of the length of said sides.

5. The stackable toolbox of claim 1 wherein said first and second lateral projections each comprises at least three spaced apart sections defining plural intervening gaps.

6. The stackable toolbox of claim 3 wherein said first tongue has a downward face which is angled toward the inside of said first groove and said second tongue has an upward face which is at an equal angle toward the inside of said second groove.

7. The stackable toolbox of claim 3 wherein said means for mating further comprises a retaining rib, parallel to and spaced apart from said second groove fixed in a position which prevents said first tongue from moving laterally out of said second groove.

8. The stackable toolbox of claim 3 wherein said first tongue has a downward face which is angled toward the inside of said first groove and said second tongue has an upward face which is at an equal angle toward the inside of said second groove and further comprising a retaining rib, parallel to and spaced apart from said second groove fixed in a position which prevents said first tongue from moving laterally out of said second groove.

9. The stackable toolbox of claim 1 further comprising a second means for mating having a first part attached to the top edge of one of said ends, and a second part attached to the bottom edge of the same end, said first part and said second part adapted to couple together.

10. The stackable toolbox of claim 9 wherein said second mating means comprises a tongue and a groove adapted to couple by lateral relative movement.

11. The stackable toolbox of claim 9 wherein the top of said end projects above said sides and the bottom of said end is raised an equal amount above the bottom of said sides.

12. A stackable toolbox comprising:

(a) a box comprising 2 parallel opposing sides, 2 parallel opposing ends connected to said sides, and a bottom connected to said sides and said ends;

(b) means for mating two boxes, a first part of said mating means, comprising a first tongue and groove, attached to the top edge of each of said sides, and a second part, comprising a second tongue and groove, attached to the bottom edge of each of said sides, adapted to be received in said first tongue and groove by relative sliding movement along their longitudinal axis;

(c) a retaining rib, parallel to and spaced apart from said second tongue and groove fixed in a position which prevents said first tongue and groove from moving laterally away from said second tongue and groove;

(d) latching means for preventing relative movement between two stacked toolboxes; and (e) a second means for mating with a first part of said mating means, comprising a third tongue and groove, attached to the top edge of one of said ends, and a second part, comprising a fourth tongue and groove, attached to the bottom edge of the same of said ends, said third and fourth tongue and grooves adapted to couple by lateral relative movement.

13. The stackable toolbox of claim 12 wherein said first tongue of has a downward face which is angled toward the inside of said first groove and said second tongue has an upward face which is at an equal angle toward the inside of said second groove.

14. The stackable toolbox of claim 13 wherein said first and second tongues each comprise two spaced apart sections defining an intervening gap longer than said sections.

15. A toolbox storage system comprising:

(a) at least one toolbox comprising (i) a box comprising 2 parallel opposing sides, 2 parallel opposing ends connected to said sides, and a bottom connected to said sides and said ends;

(ii) means for mating two toolboxes, a first part of said mating means, comprising a first tongue and groove, attached to the top edge of each of said sides, and a second part, comprising a second tongue and groove, attached to the bottom edge of each of said sides, said first tongue and groove adapted to be received in said second tongue and groove by relative sliding movement along their longitudinal axis; and (iii) first latching means for preventing relative movement between two stacked toolboxes; and (b) a toolbox cover comprising a top surface and two sets of parallel, spaced apart tongues and grooves attached to said top surface and adapted to be received in said first tongue and groove by relative sliding movement along their longitudinal axis; and (c) a toolbox rack mount comprising a pair of parallel spaced apart rails, each of said rails comprising a tongue and a groove adapted to be received in said second tongue and groove by relative sliding movement along their longitudinal axis, and plural mounting tabs connected to said rails.

16. The toolbox storage system of claim 15 wherein said toolbox cover further comprises a handle attached to said top surface.

17. The toolbox storage system of claim 15 wherein said toolbox rack mount further comprises a second latch adapted to engage said toolbox after said toolbox has been inserted into said rack mount and to prevent said toolbox from being fully withdrawn from said rack mount.

* * * * *